US012686896B2

(12) United States Patent
Tobata et al.

(10) Patent No.: US 12,686,896 B2
(45) Date of Patent: Jul. 21, 2026

(54) DEHYDROGENATION METHOD FOR STEEL MATERIAL AND STEEL PRODUCT, AND PRODUCTION METHOD FOR STEEL MATERIAL AND STEEL PRODUCT

(71) Applicant: JFE STEEL CORPORATION, Tokyo (JP)

(72) Inventors: Junya Tobata, Tokyo (JP); Kazuki Endoh, Tokyo (JP); Yuki Toji, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 659 days.

(21) Appl. No.: 18/004,881

(22) PCT Filed: May 26, 2021

(86) PCT No.: PCT/JP2021/019985
§ 371 (c)(1),
(2) Date: Jan. 10, 2023

(87) PCT Pub. No.: WO2022/014172
PCT Pub. Date: Jan. 20, 2022

(65) Prior Publication Data

US 2023/0243006 A1 Aug. 3, 2023

(30) Foreign Application Priority Data

Jul. 14, 2020 (JP) ..... 2020-120971

(51) Int. Cl.
*C21D 3/06* (2006.01)
*C21D 7/02* (2006.01)
(Continued)

(52) U.S. Cl.
CPC ..... *C21D 3/06* (2013.01); *C21D 7/02* (2013.01); *C21D 7/13* (2013.01); *C21D 9/08* (2013.01);
(Continued)

(58) Field of Classification Search
CPC ... C21D 3/06; C21D 7/02; C21D 7/13; C21D 9/08; C21D 9/46; C21D 9/52;
(Continued)

(56) References Cited

U.S. PATENT DOCUMENTS 3,276,918 A 10/1966 Langenecker
3,673,009 A 6/1972 Levy
(Continued)

FOREIGN PATENT DOCUMENTS

CN 101692382 A 4/2010
CN 104692322 A 6/2015
(Continued)

OTHER PUBLICATIONS

Outokumpu: "Handbook of Stainless Steel", Oct. 1, 2013 (Year: 2013).*
(Continued)

*Primary Examiner* — Rebecca Janssen
(74) *Attorney, Agent, or Firm* — KENJA IP LAW PC

(57) ABSTRACT

Provided is a dehydrogenation method capable of efficiently reducing hydrogen content in steel for thick or complexly-shaped steel materials and steel products in general. In a dehydrogenation method for a steel material, in a series of steel material production process including: a process of supplying a steel raw material; a process of subjecting the steel raw material to hot working; a process of inspecting a steel material obtained from the steel raw material; and a process of shipping the steel material, at least one of the steel raw material and the steel material at any stage from the
(Continued)

supply process to the shipment process is subjected to, at least once, a sound wave irradiation treatment so that a sound pressure level at a surface of the at least one of the steel raw material and the steel material will be 30 dB or more.

11 Claims, 7 Drawing Sheets

(51) Int. Cl.

| | |
|---|---|
| ***C21D 7/13*** | (2006.01) |
| ***C21D 9/08*** | (2006.01) |
| ***C21D 9/46*** | (2006.01) |
| ***C21D 9/52*** | (2006.01) |
| ***C21D 10/00*** | (2006.01) |

(52) U.S. Cl.
CPC ..... *C21D 9/46* (2013.01); *C21D 9/52* (2013.01); *C21D 10/00* (2013.01)

(58) Field of Classification Search
CPC ..... C21D 10/00; C21D 8/005; C21D 8/0221; C21D 8/065; C21D 8/105; C21D 9/0068; C21D 9/525; C21D 6/002; C21D 6/004; C21D 11/00; C21D 7/00; C22C 38/00; C22C 38/04; C22C 38/60
See application file for complete search history.

(56) References Cited

U.S. PATENT DOCUMENTS

| | | | | |
|---|---|---|---|---|
| 2003/0037849 | A1 | 2/2003 | Suzuki | |
| 2007/0068605 | A1* | 3/2007 | Statnikov ..... | C21D 10/00 148/558 |
| 2009/0263269 | A1 | 10/2009 | Murakami et al. | |
| 2011/0036467 | A1 | 2/2011 | Stebbing | |
| 2016/0214351 | A1 | 7/2016 | Harako et al. | |
| 2020/0399734 | A1 | 12/2020 | Blaise et al. | |
| 2021/0010101 | A1 | 1/2021 | Endo et al. | |
| 2021/0010115 | A1 | 1/2021 | Yoshitomi et al. | |
| 2021/0115529 | A1 | 4/2021 | Yoshitomi et al. | |

FOREIGN PATENT DOCUMENTS

| | | | |
|---|---|---|---|
| CN | 105531388 | A | 4/2016 |
| CN | 106086638 | A | 11/2016 |
| CN | 107406911 | A | 11/2017 |
| CN | 108296222 | A | 7/2018 |
| CN | 110055389 | A | 7/2019 |
| CN | 110735085 | A | 1/2020 |
| EP | 2489632 | A1 | 8/2012 |
| JP | S55154517 | A | 12/1980 |
| JP | H05140642 | A | 6/1993 |
| JP | 06041711 | A | 2/1994 |
| JP | 2000219985 | A | 8/2000 |
| JP | 2003221641 | A | 8/2003 |
| JP | 2004131794 | A | 4/2004 |
| JP | 2006037130 | A | 2/2006 |
| JP | 2007211280 | A | 8/2007 |
| JP | 2008208451 | A | 9/2008 |
| KR | 1020050086683 | A | 8/2005 |
| KR | 1020190078013 | A | 7/2019 |
| RU | 2197541 | C1 | 1/2003 |
| RU | 2014113836 | A | 10/2015 |
| RU | 2578859 | C2 * | 3/2016 |
| WO | 0246479 | A1 | 6/2002 |
| WO | 2016130470 | A1 | 8/2016 |
| WO | 2019188642 | A1 | 10/2019 |
| WO | 2019189842 | A1 | 10/2019 |
| WO | 2019189849 | A1 | 10/2019 |

OTHER PUBLICATIONS

Henry E Bass et al: "Ultrasonic Background Noise In Industrial Environments", The Journal Of The Acoustical Society Of America, American Institute Of Physics, 2 Huntington Quadrangle, Melville, NY 11747, vol. 78, No. 6, Dec. 1, 1985 (Dec. 1, 1985), pp. 2013-2016 (Year: 1985).*

Liu Defu et al., Research on Flakes Formation in Roll Blanks of Cold Rolling Mill and Its Prevention, Heavy Casting and Forging, Jul. 2008, No. 4.

Mar. 30, 2024, Office Action issued by the China National Intellectual Property Administration in the corresponding Chinese Patent Application No. 202180049826.5 with English language search report.

Yuri A. Yakovlev et al., Protection of materials from hydrogen accumulation, E3S Web of Conferences, Corrosion in the Oil & Gas Industry 2019, 2019, vol. 121.

Aug. 17, 2021, International Search Report issued in the International Patent Application No. PCT/JP2021/019985.

Jul. 10, 2023, the Extended European Search Report issued by the European Patent Office in the corresponding European Patent Application No. 21843361.3.

Henry E. Bass et al., Ultrasonic background noise in industrial environments, Journal of the Acoustical Society of America, Dec. 1985, pp. 2013-2016, vol. 78, No. 6, XP001422214.

N.A., Bar & Wire Rod Unit of Nippon Steel Steel Bars / Wire Rods, Mar. 24, 2020, XP093058861, from URL: https://www.nipponsteel.com/product/catalog_download/pdf/B001en.pdf, retrieved on Jun. 28, 2023.

N.A., Cold Rolled Steel Sheet, Aug. 30, 2018, XP093058857, from URL: https://www.jfe-steel.co.jp/en/products/sheets/catalog/ble-002.pdf, retrieved on Jun. 28, 2023.

Outokumpu, Handbook of Stainless Steel, Oct. 1, 2013, XP055247421, from URL: http://www.outokumpu.com/SiteCollectionDocuments/Outokumpu-stainless-steel-handbook.pdf, retrieved on Feb. 4, 2016.

Aug. 19, 2024, Office Action issued by the China National Intellectual Property Administration in the corresponding Chinese Patent Application No. 202180049826.5 with English language concise statement of relevance.

Jan. 16, 2025, Office Action issued by the Korean Intellectual Property Office in the corresponding Korean Patent Application No. 10-2023-7002674 with English language concise statement of relevance.

* cited by examiner

DEHYDROGENATION METHOD FOR STEEL MATERIAL AND STEEL PRODUCT, AND PRODUCTION METHOD FOR STEEL MATERIAL AND STEEL PRODUCT

TECHNICAL FIELD

The present disclosure relates to a dehydrogenation method of reducing hydrogen content in steel and a production method using the dehydrogenation method for steel materials and steel products in general. The present disclosure is suitable for use in all fields where steel products are used, such as railroads, automobiles, building materials, and machinery, and contributes to the provision of steel materials and steel products without a decrease in quality caused by hydrogen.

BACKGROUND

During or after the production of various steel materials yielded from steel raw materials, such as steel plates, shape steels, steel pipes or tubes, and bars or wires, hydrogen enters and remains in the steel. Although there is no consensus yet about how such residual hydrogen affects the quality of the steel materials and steel products produced using the steel materials, many reports indicate that residual hydrogen causes the quality of steel materials and steel products to decrease in terms of workability such as ductility and bendability, fatigue resistance, creep resistance, fracture mechanics property, etc. There is thus a need to reduce hydrogen content in steel from the viewpoint of improving the quality of these steel materials and steel products.

As a method of reducing hydrogen content in steel, for example, there is a known method that, in the case of producing a steel sheet of less than 6 mm in thickness, leaves the steel sheet after coating or plating at room temperature for several weeks or more or holds the steel sheet after coating or plating at about 100° C. for several tens of hours.

As another example, WO 2019/188642 A1 (PTL 1) discloses a method of reducing hydrogen content in steel by, after producing a steel sheet of less than 2 mm in thickness, holding the steel sheet in a temperature range of 50° C. or more and 300° C. or less for 1800 seconds or more and 43200 seconds or less as a final heat treatment.

CITATION LIST

Patent Literature

PTL 1: WO 2019/188642 A1

SUMMARY

Technical Problem

Each of these methods has the dehydrogenation effect on steel sheets, but cannot be applied to thick steel materials or steel products, or steel materials or steel products having complex shapes after working.

Moreover, with the dehydrogenation treatment described in PTL 1, it takes time for hydrogen to move from the inside to the surface of the steel sheet and desorb from the surface. Thus, the space and time required for the dehydrogenation treatment pose a problem in the production process. There is also concern that the heating treatment may cause microstructural changes and mechanical property changes of the steel sheet.

It could therefore be helpful to provide a dehydrogenation method capable of efficiently reducing hydrogen content in steel and applicable to thick or complexly-shaped steel materials and steel products in general. It could also be helpful to provide a production method capable of producing, by using the dehydrogenation method, steel materials and steel products without a decrease in quality caused by residual hydrogen.

Solution to Problem

Upon careful examination, we discovered the following: By irradiating various steel materials and steel products having large thicknesses or complex shapes with sound waves under predetermined conditions, the amount of hydrogen in steel (referred to as "hydrogen content in steel") can be reduced sufficiently and efficiently.

This is presumed to be due to the following mechanism: By irradiating a steel material or steel product with sound waves to forcibly microvibrate the steel material or steel product, the steel material or steel product undergoes repeated bending deformation. As a result, the lattice spacing of the surface expands as compared with the inside in the steel material or steel product. Hydrogen in the steel material or steel product diffuses toward the surface with wide lattice spacing and low potential energy, and desorbs from the surface.

The present disclosure is based on these discoveries. We thus provide:

1. A dehydrogenation method for a steel material, wherein in a series of steel material production process including: a supply process of supplying a steel raw material; a hot working process of subjecting the steel raw material to hot working; an inspection process of inspecting a steel material obtained from the steel raw material; and a shipment process of shipping the steel material, at least one of the steel raw material and the steel material at any stage from the supply process to the shipment process is subjected to, at least once, a treatment of irradiating with sound waves so that a sound pressure level at a surface of the at least one of the steel raw material and the steel material will be 30 dB or more.

The "series of steel material production process" in 1. means a typical steel material production process in steelworks, and particularly refers to a production process from a process of supplying a steel raw material in a solid state, which is after a casting process and/or an ingot casting process in which the steel raw material turns into a solid, to a process of shipping a steel material from a steelworks.

The "steel material" in 1. means any type of object steel subjected to any process after the steel raw material supply process in the steelworks, or any type of object steel that is ready for inspection and shipment after completion of working in the steelworks.

Herein, the "sound pressure level" can be measured, for example, by the below-described method.

2. The dehydrogenation method according to 1., wherein the series of steel material production process further includes a cold working process of subjecting the steel material after the hot working process to cold working.

3. A dehydrogenation method for a steel product, wherein in a series of steel product production process including: a transportation process of transporting a steel material shipped from a steelworks; a storage process of storing the steel material; and a working process of working the steel material to obtain a steel product, at least one of the steel material and the steel product at any stage from the shipped steel material to any process out of the transportation process, the storage process, and the working process is subjected to, at least once, a treatment of irradiating with sound waves so that a sound pressure level at a surface of the at least one of the steel material and the steel product will be 30 dB or more.

The "series of steel product production process" in 3. includes any process after a process of shipping a steel material from a steelworks, for example, a process in which any person or entity such as a transporter, a receiver, or a processor of the steel material handles the steel material.

The "steel material" and the "sound pressure level" in 3. are as defined in 1. The "steel product" refers to any type of steel product obtained using the steel material shipped from the steelworks.

4. The dehydrogenation method according to any one of 1. to 3., wherein the sound waves have a frequency from 10 Hz to 100000 Hz.

Herein, the "frequency" can be measured, for example, by the below-described method.

5. The dehydrogenation method according to any one of 1. to 4., wherein a sound wave irradiation time in the treatment of irradiating with the sound waves is 1 second or more.

6. A production method for a steel material, comprising the dehydrogenation method according to 1.

7. A production method for a steel product, comprising the dehydrogenation method according to 3.

Advantageous Effect

It is thus possible to efficiently reduce hydrogen content in steel of thick or complexly-shaped steel materials and steel products in general. It is also possible to produce, by using the dehydrogenation method, steel materials and steel products without a decrease in quality caused by residual hydrogen.

DETAILED DESCRIPTION

Figure 1:
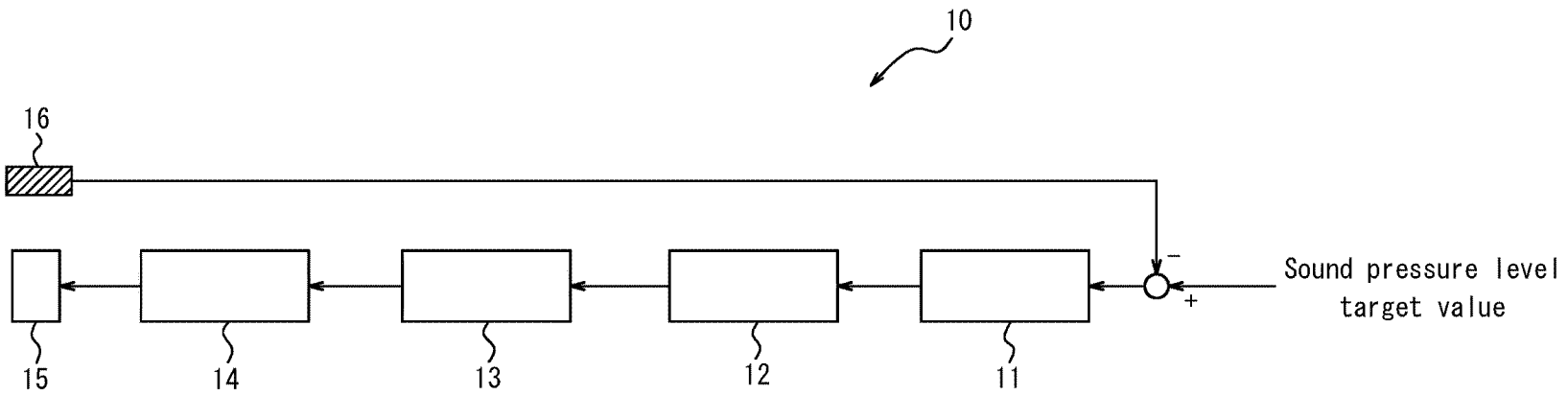
FIG. 1 is a schematic view illustrating the structure of a sound wave irradiator 10 used in an embodiment of the present disclosure.

An embodiment of the present disclosure will be described in detail below.

The embodiment described below represents a preferred example of the present disclosure. The present disclosure is not limited to such embodiment, and various changes are possible within the scope of the present disclosure.

Dehydrogenation Method

[Steel Material and Steel Product]

A steel material as an object of a dehydrogenation method according to the present disclosure is any type of object steel subjected to any process after a steel raw material supply process in a steelworks, or any type of object steel that is ready for inspection and shipment after completion of working in the steelworks. Specific examples of the steel material include steel plates, shape steels, steel pipes or tubes, and bars or wires (that is, various steel materials except steel sheets) produced from steel raw materials, and workpieces in working stages to obtain these steel materials. Herein, bars or wires include steel bars, wire rods, and wires.

A steel product as an object of a dehydrogenation method according to the present disclosure is a steel product obtained using a steel material shipped from a steelworks. Specific examples of the steel product include various finished products obtained by working and/or assembling steel plates, shape steels, steel pipes or tubes, and/or bars or wires such as steel bars, wire rods, and wires (that is, various steel materials except steel sheets), for example, ships, rails, vehicles, buildings, precision instruments, tools, and intermediate parts thereof.

Steel materials and steel products are normally in a solid state.

In the case where the steel material is a steel plate, its thickness is 6 mm or more. Shape steels include those with any shapes, such as H-beams, I-beams, T-beams, and L-beams. Steel pipes or tubes include those with any shapes by any production methods, such as forge welded steel pipes or tubes, electric resistance welded steel pipes or tubes, seamless steel pipes or tubes, and arc welded steel pipes or tubes. Bars or wires include any bar-shaped or wire-shaped steel materials, such as bars as general machine parts such as shafts and wires such as piano wires and iron wires.

[Chemical Composition]

The chemical composition of the steel material is not limited. As long as the steel material is irradiated with sound waves under predetermined conditions, the hydrogen content in steel can be reduced regardless of the chemical composition.

The steel material may be made of alloy steel having a chemical composition containing iron (Fe) as a main component and containing any alloying elements in any small amounts depending on the desired properties, such as C, Si, Mn, P, S, N, Al, Ti, Nb, V, W, B, Ni, Cr, Mo, Cu, Sn, Sb, Ta, Ca, Mg, Zr, and REM (rare earth metal).

The chemical composition of the steel product is not limited, either. A main part of the steel product typically has the same chemical composition as the steel material.

A specific example of the chemical composition will be described below. In the following description, "mass %" is simply expressed as "%".

An alloying element added to iron typically has the effect of suppressing the expansion of lattice spacing in steel. Hence, if the content of the alloying element added is excessively high, the potential energy difference generated between the surface and the inside of the steel by sound wave irradiation decreases, as a result of which the reduced hydrogen ratio is likely to decrease. In the case of adding alloying elements (C, Si, Mn, Al, P, S, N, Ni, Cr, Mo, Ti, Nb, V, W, B, Cu, Sn, Sb, Ta, Ca, Mg, Zr, REM) to iron, the respective addition amounts preferable from the viewpoint of ensuring the reduced hydrogen ratio are as follows:

The C content is preferably 2.000% or less, and more preferably 0.600% or less. Under manufacturing constraints, the C content is preferably 0.0005% or more, and more preferably 0.0010% or more.

The Si content is preferably 7.00% or less, more preferably 2.00% or less, and may be 0%.

The Mn content is preferably 40.00% or less, more preferably 10.00% or less, and may be 0%.

The P content is preferably 0.500% or less, more preferably 0.100% or less, and may be 0%.

The S content is preferably 0.500% or less, more preferably 0.300% or less, further preferably 0.100% or less, and may be 0%.

The N content is preferably 2.0000% or less, more preferably 0.1000% or less, and may be 0%.

The Al content is preferably 5.000% or less, and may be 0%.

The Ti content is preferably 0.600% or less, and may be 0%.

The Nb content is preferably 1.000% or less, more preferably 0.500% or less, and may be 0%.

The V content is preferably 0.500% or less, more preferably 0.200% or less, and may be 0%.

The W content is preferably 10.000% or less, and may be 0%.

The B content is preferably 0.1000% or less, more preferably 0.0100% or less, and may be 0%.

The Ni content is preferably 40.000% or less, more preferably 1.000% or less, and may be 0%.

The Cr content is preferably 50.000% or less, more preferably 30.000% or less, and may be 0%.

The Mo content is preferably 10.000% or less, more preferably 2.000% or less, and may be 0%.

The Cu content is preferably 5.000% or less, more preferably 1.000% or less, and may be 0%.

The Sn content is preferably 1.000% or less, and may be 0%.

The Sb content is preferably 1.000% or less, more preferably 0.100% or less, and may be 0%.

The Ta content is preferably 1.000% or less, and may be 0%.

The Ca content is preferably 0.3000% or less, and may be 0%.

The Mg content is preferably 0.0050% or less, and may be 0%.

The Zr content is preferably 0.6000% or less, and may be 0%.

The REM content is preferably 0.0050% or less, and may be 0%.

The balance other than the components described above may consist of inevitable impurities.

The steel material may be a stainless steel material having a chemical composition containing 10% or more Cr, such as a stainless steel plate, a stainless shape steel, a stainless steel pipe or tube, or a stainless bar or wire. Likewise, the steel product may be a stainless steel product produced using a stainless steel material having a chemical composition containing 10% or more Cr. An example of the chemical composition of the stainless steel material and the stainless steel product is SUS430 (alloying element content: 0.10% C-0.5 Si-0.8 Mn-17 Cr).

[Steel Material Production Process]

In the dehydrogenation method for a steel material according to the present disclosure, in a series of steel material production process including: a supply process of supplying a steel raw material; a hot working process of subjecting the steel raw material to hot working; an inspection process of inspecting a steel material obtained from the steel raw material; and a shipment process of shipping the steel material, the steel material (or the steel raw material, depending on the process) at any stage from the supply process to the shipment process is irradiated with sound waves under predetermined conditions at least once. By irradiating the object steel in the steel material production process with sound waves in this way, the hydrogen content in steel can be reduced sufficiently and efficiently, and the finally obtained steel material does not have quality loss caused by residual hydrogen. Moreover, by performing sound wave irradiation a plurality of times, the hydrogen content in steel can be reduced more than in the case of performing sound wave irradiation only once. It is therefore preferable to perform sound wave irradiation a plurality of times. In the case of performing sound wave irradiation a plurality of times, sound wave irradiation may be performed twice or more in one process, or sound wave irradiation may be performed in different processes. A combination thereof is also applicable.

Figure 2A:
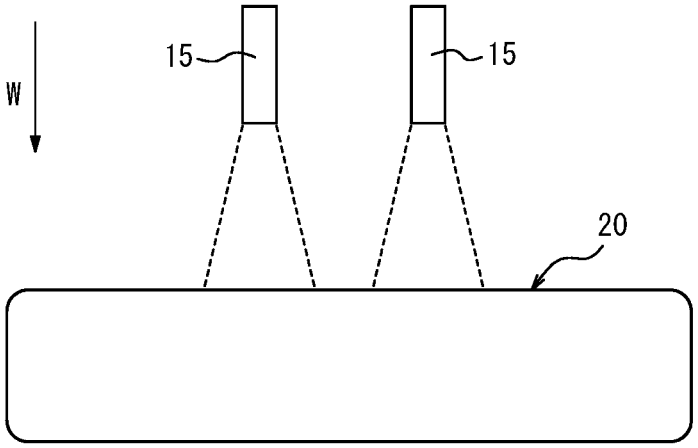
FIG. 2A is a schematic view illustrating the positional relationship between a steel material 20 and the sound wave irradiator 10 (in particular, horn 15) in an embodiment of the present disclosure, as seen laterally with respect to the main traveling direction W of sound waves.
Figure 2B:
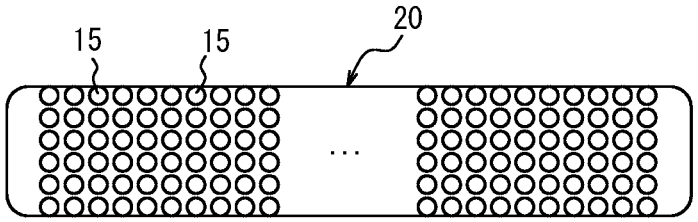
FIG. 2B is a schematic view illustrating the positional relationship between the steel material 20 and the sound wave irradiator 10 (in particular, horn 15) in an embodiment of the present disclosure, as seen from the sound wave irradiation side with respect to the direction W.

The dehydrogenation method for a steel material according to the present disclosure can be carried out, for example, by irradiating a steel material 20 with sound waves using a sound wave irradiator (i.e. a sound wave generator) 10 illustrated in FIG. 1, as illustrated in FIGS. 2A and 2B. An embodiment of the present disclosure in the case where the sound wave irradiation object is a steel material will be described below, with reference to drawings. The following description regarding a steel material also applies to the case where the sound wave irradiation object is a steel raw material or a steel product other than a steel material.

[Sound Wave Irradiation Means]

The sound wave irradiation for the steel material can be performed by applying, from the typical sound wave irradiator 10 illustrated in FIG. 1, sound waves to any part of the steel material 20 subjected to any of the below-described processes.

The sound wave irradiator 10 typically includes a controller 11, a sound wave oscillator 12, a vibration transducer (speaker) 13, a booster (amplifier) 14, a horn 15, and a sound level meter 16. The sound wave oscillator 12 converts an electrical signal of a typical frequency (for example, 50 Hz or 60 Hz) into an electrical signal of a desired frequency, and transmits the electrical signal to the vibration transducer 13. While the voltage is typically AC 200 V to 240 V, it is amplified to nearly 1000 V in the sound wave oscillator 12. The electric signal of the desired frequency transmitted from the sound wave oscillator 12 is converted into mechanical vibration energy by a piezoelectric element in the vibration transducer 13, and the mechanical vibration energy is transmitted to the booster 14. The booster 14 amplifies the amplitude of the vibration energy transmitted from the vibration transducer 13 (or converts it into an optimum amplitude), and transmits the resultant vibration energy to the horn 15. The horn 15 is a member that imparts directivity to the vibration energy transmitted from the booster 14 and propagates it through the air as directional sound waves.

As a preferred example, the horn 15 may be a cylindrical member from the viewpoint of irradiating the steel material with directional sound waves. The shape of the horn 15 is, however, not limited to a cylinder as long as the steel material can be irradiated under the predetermined conditions. As illustrated in FIGS. 2A and 2B, one or more sound wave irradiators 10 are installed so that sound waves will reach any part of the steel material 20. The part of the steel material 20 to be reached by sound waves is preferably the main surface of the steel material 20 having a relatively large area, from the viewpoint of efficiently receiving desired sound waves. As illustrated in FIG. 2A, the main traveling direction W of the sound waves is preferably perpendicular to the irradiated surface or irradiated part of the steel material 20 (including approximately perpendicular to the irradiated surface or irradiated part depending on the nature of the operation and the shape of the steel material, for example, in the case where the irradiated surface is a curved surface, perpendicular or approximately perpendicular to the tangent plane to the curved surface). Moreover, by irradiating the steel material 20 with sound waves from an irradiator group made up of a plurality of sound wave irradiators 10 located apart from (preferably vertically above) the surface of the steel material 20 with any spacing as illustrated in FIG. 2B, the entire surface of the steel material 20 can be efficiently exposed to the sound waves. Thus, in the case of passing the steel material 20, the surface of the steel material 20 can be exposed to the sound waves for sufficient time. In this way, the sound wave irradiation can be performed without contacting the steel material.

[Sound Wave Irradiation Conditions]

Sound Pressure Level

To reliably apply vibration to the steel material and promote the diffusion of hydrogen, it is important that the sound pressure level at the surface of the steel material in the sound wave irradiation treatment is 30 dB or more. The sound pressure level at the surface of the steel material is preferably 60 dB or more, and more preferably 80 dB or more. The sound pressure level at the surface of the steel material in the sound wave irradiation treatment is typically 150 dB or less and preferably 140 dB or less, in view of the performance of commonly available sound wave irradiators. The sound pressure level at the surface of the steel material 20 can be adjusted by changing as appropriate the intensity (e.g. output) of the sound waves generated from the sound wave irradiator 10 and/or the installation position of the sound wave irradiator 10 (i.e. the distance between the sound wave irradiator 10 and the irradiated surface of the steel material 20). The sound pressure level at the surface of the steel material 20 can be measured by installing the sound level meter 16 at a position in the steel material 20 that is in the vicinity of the surface irradiated with sound waves and is closest to the sound wave irradiator 10.

Frequency

If the frequency of the sound waves with which the steel material is irradiated is less than 10 Hz, the vibration applied by the sound wave irradiation is hindered by the rigidity of the steel material, and the diffusion of hydrogen in the steel material is not promoted. This results in insufficient reduction of the hydrogen content in steel. Accordingly, the frequency of the sound waves with which the steel material is irradiated is preferably 10 Hz or more, more preferably 100 Hz or more, further preferably 500 Hz or more, and even more preferably 1000 Hz or more. If the frequency of the sound waves with which the steel material is irradiated is more than 100000 Hz, the generated sound waves attenuate significantly in the air, and sufficient vibration is not applied to the surface of the steel material. This makes it difficult to efficiently reduce the hydrogen content in steel. Accordingly, the frequency of the sound waves with which the steel material is irradiated is preferably 100000 Hz or less.

The frequency of the sound waves applied can be set as appropriate, for example, on the sound wave output side of the sound wave irradiator 10 or the like. From the viewpoint of enhancing the effect of the frequency on the delayed fracture resistance, the shortest straight-line distance between the surface of the steel material 20 and the sound wave irradiator 10 is preferably 15 m or less, and more preferably 5 m or less.

Irradiation Time

The sound wave irradiation time for the steel material in the sound wave irradiation treatment is preferably 1 second or more, more preferably 5 seconds or more, and further preferably 10 seconds or more, from the viewpoint of sufficiently reducing the hydrogen content in steel by desorbing hydrogen from the steel material. The sound wave irradiation time for the steel material is preferably 3600 seconds or less, more preferably 1800 seconds or less, and further preferably 900 seconds or less, from the viewpoint of not hampering the productivity.

Herein, the "sound wave irradiation time for the steel material" denotes the total time for which a surface of the steel material is exposed to sound waves during one process (e.g. hot working process, inspection process, etc.). In the case where the surface is exposed to sound waves from a plurality of sound wave irradiators 60 at a time or in the case where the surface is exposed to sound waves a plurality of times during one process, the "sound wave irradiation time for the steel material" denotes the cumulative time. For example, the irradiation time may be adjusted by adjusting the irradiation time of each single sound wave irradiator 10 individually, by adjusting the number of times irradiation is performed by the sound wave irradiator 10, or by adjusting the number of sound wave irradiators 10 constituting the irradiator group. The irradiation time in the case of irradiating the steel material that is being passed with sound waves may be adjusted based on the passing speed of the steel material and the number of irradiator groups, which are each made up of a plurality of sound wave irradiators 10, arranged in the passing direction.

[Sound Wave Irradiation Process]

In the dehydrogenation method for a steel material, in a steel material production process including a supply process, a hot working process such as hot rolling, an inspection process, and a shipment process, a steel material (or steel raw material) at any stage from the supply process to the shipment process is irradiated with sound waves under the foregoing conditions at least once. The steel material production process may further include, between the supply process and the shipment process, a cold working process such as cold rolling, a heat treatment process such as annealing, and any other process specialized for obtaining each steel material, in any order. The sound wave irradiation is performed at least once in any of the foregoing processes.

Normally, the steel raw material and the subsequent steel material are in a solid state as a result of undergoing a casting process or an ingot casting process that precedes the foregoing processes. The processes after the casting process or the ingot casting process in which the steel material turns into a solid differ depending on the type of the steel material. Typical flow is as follows.

Figure 3:
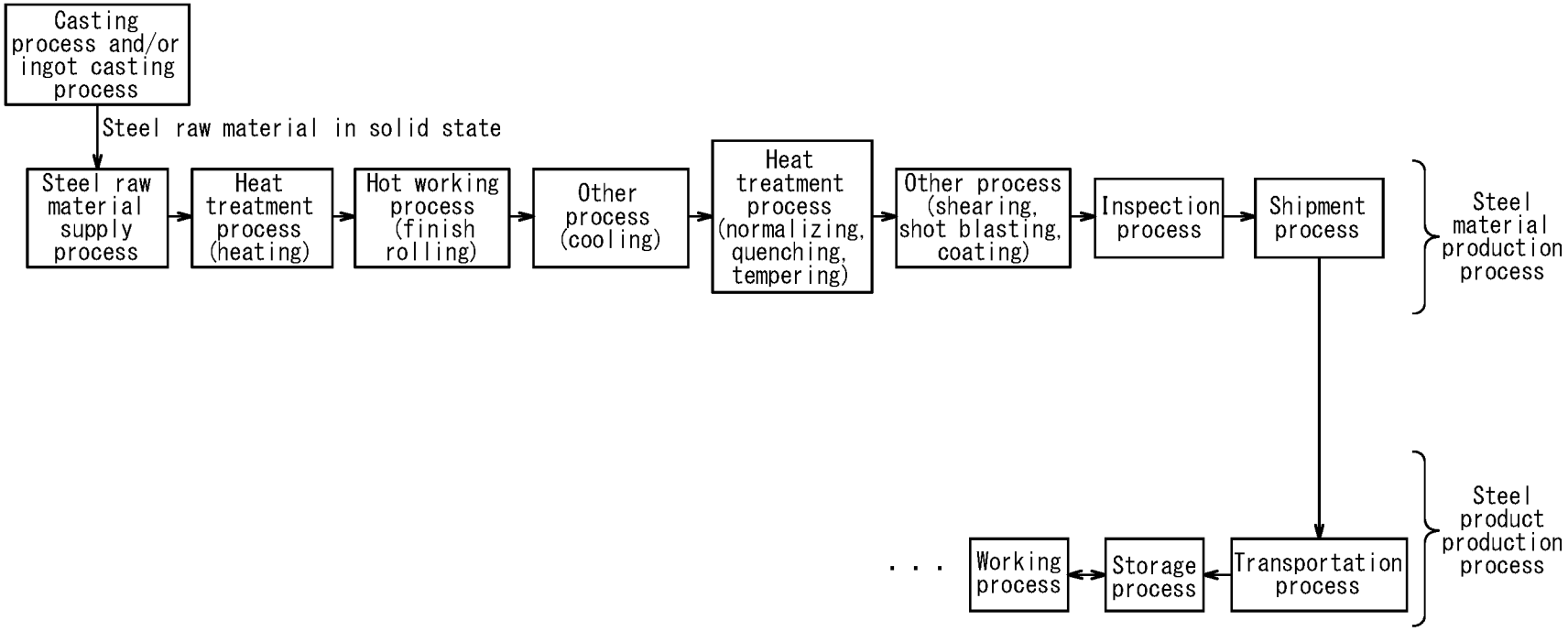
FIG. 3 is a flowchart illustrating an example of a production process in the case where a steel material is a steel plate.

FIG. 3 illustrates an example of steel plate production flow. In a steel plate production process in the upper part of FIG. 3, a casting process and/or an ingot casting process such as a continuous casting process is followed by a steel raw material supply process; a heat treatment process such as heating; a hot working process such as finish rolling; other process such as cooling; a heat treatment process such as normalizing, quenching, and tempering; other process such as shearing, shot blasting, and coating; and thereafter an inspection process and a shipment process.

As long as the sound wave irradiation is performed under the predetermined conditions, the hydrogen content in steel in the final steel plate can be reduced regardless of in which of these processes the sound wave irradiation is performed. Given that hydrogen inevitably enters into the steel in each process, from the viewpoint of shipping the steel material in a state in which the hydrogen content in steel is reduced more, the sound wave irradiation is preferably performed in the shipment process and/or a process close to the shipment process, namely, the inspection process, the coating process, or the shot blasting process, more preferably performed in the inspection process or the coating process, and further preferably performed in the inspection process. From the viewpoint of further reducing the final hydrogen content in steel, the sound wave irradiation is particularly preferably performed in two or more processes made up of the inspection process and any of the foregoing processes.

Figure 4:
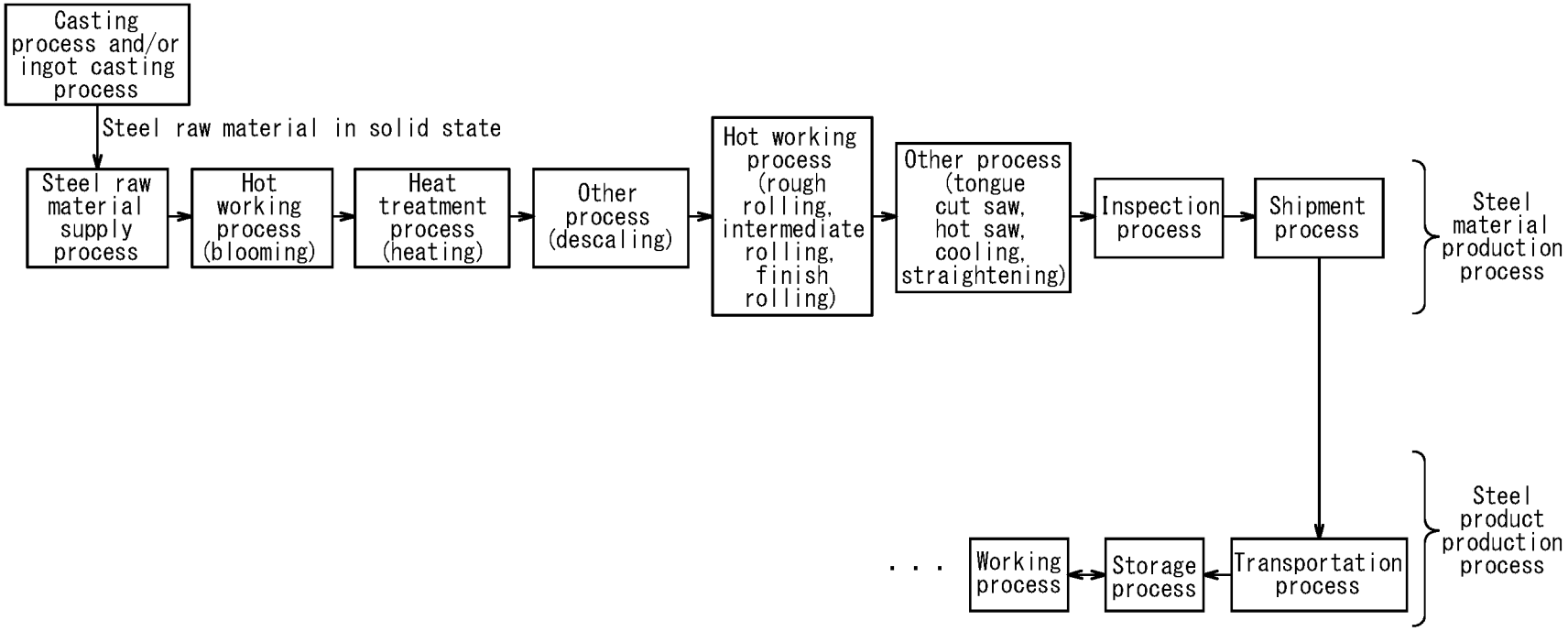
FIG. 4 is a flowchart illustrating an example of a production process in the case where a steel material is a shape steel.

FIG. 4 illustrates an example of shape steel production flow. In a shape steel production process in the upper part of FIG. 4, a casting process and/or an ingot casting process such as a continuous casting process is followed by a steel raw material supply process; a hot working process such as blooming; a heat treatment process such as heating; other process such as oxide film removal (descaling); a hot working process such as hot rolling, for example, rough rolling and intermediate rolling; other process such as tongue cut saw; a hot working process such as hot rolling, for example, finish rolling; other process such as hot saw, cooling, and straightening; and thereafter an inspection process and a shipment process.

As long as the sound wave irradiation is performed under the predetermined conditions, the hydrogen content in steel in the final shape steel can be reduced regardless of in which of these processes the sound wave irradiation is performed. Given that hydrogen inevitably enters into the steel in each process, from the viewpoint of shipping the steel material in a state in which the hydrogen content in steel is reduced more, the sound wave irradiation is preferably performed in the shipment process and/or a process close to the shipment process, namely, the inspection process or the straightening process, and more preferably performed in the inspection process. From the viewpoint of further reducing the final hydrogen content in steel, the sound wave irradiation is particularly preferably performed in two or more processes made up of the inspection process and any of the foregoing processes.

In the case of applying sound waves in the shape steel straightening process, for example, the shape steel is passed through the straightener and irradiated with sound waves using the sound wave irradiator installed on the exit side of the straightener.

Figure 5:
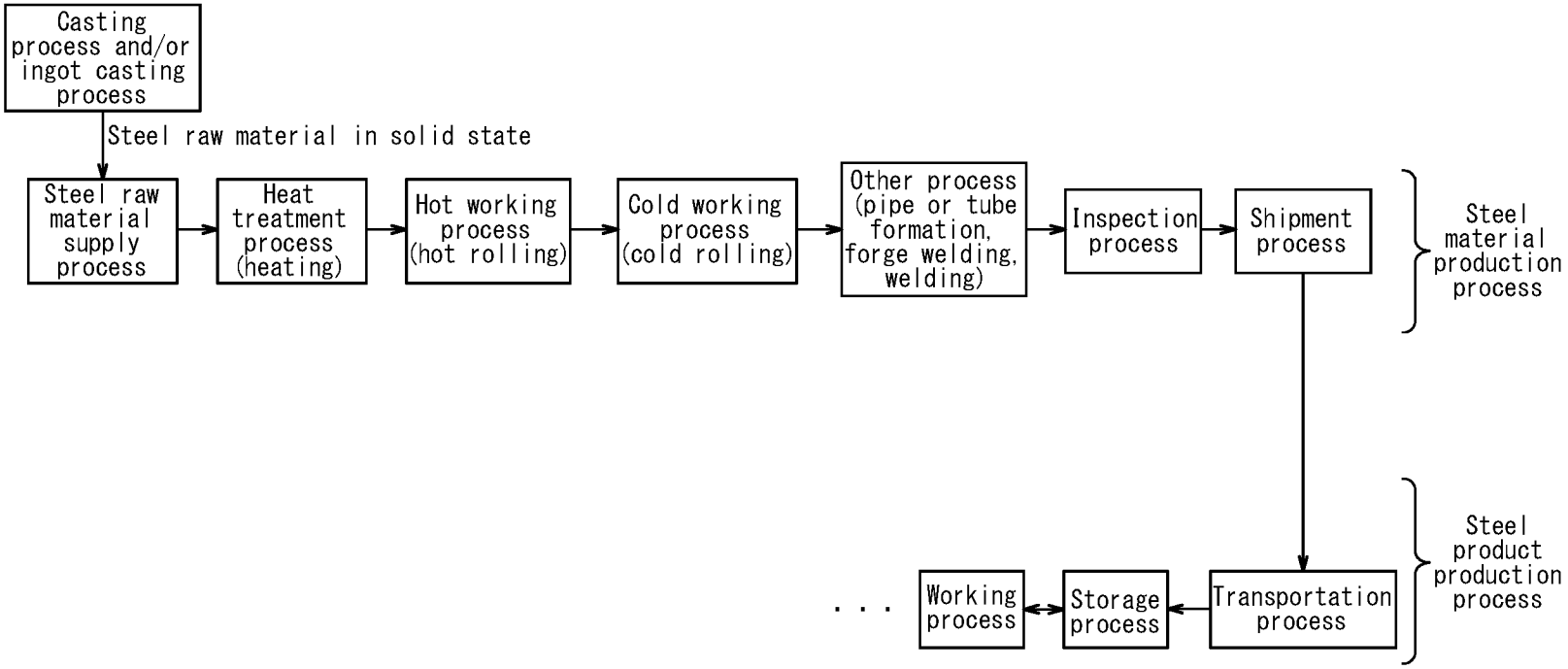
FIG. 5 is a flowchart illustrating an example of a production process in the case where a steel material is a steel pipe or tube.

FIG. 5 illustrates an example of steel pipe or tube production flow. In a steel pipe or tube production process in the upper part of FIG. 5, a casting process and/or an ingot casting process such as a continuous casting process is followed by a steel raw material supply process; a heat treatment process such as heating; a hot working process such as hot rolling, a cold working process such as cold rolling; other process such as pipe or tube formation, forge welding, and welding; and thereafter an inspection process and a shipment process.

As long as the sound wave irradiation is performed under the predetermined conditions, the hydrogen content in steel in the final steel pipe or tube can be reduced regardless of in which of these processes the sound wave irradiation is performed. Given that hydrogen inevitably enters into the steel in each process, from the viewpoint of shipping the steel material in a state in which the hydrogen content in steel is reduced more, the sound wave irradiation is preferably performed in the shipment process and/or a process close to the shipment process, namely, the inspection process, the welding process, or the forge welding process, more preferably performed in the inspection process or the welding process, and further preferably performed in the inspection process. From the viewpoint of further reducing the final hydrogen content in steel, the sound wave irradiation is particularly preferably performed in two or more processes made up of the inspection process and any of the foregoing processes.

Figure 6:
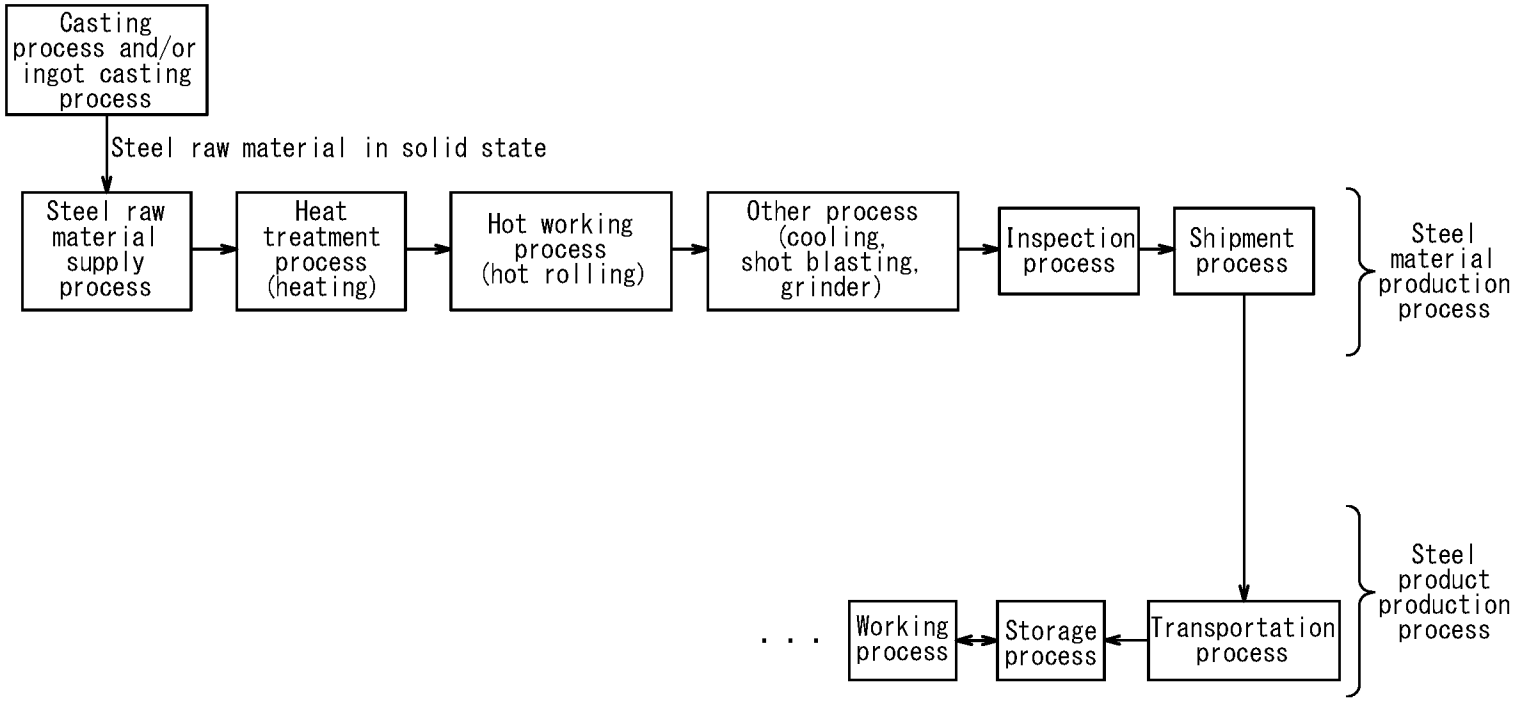
FIG. 6 is a flowchart illustrating an example of a production process in the case where a steel material is a steel bar.

FIG. 6 illustrates an example of bar or wire production flow. In a bar or wire production process in the upper part of FIG. 6, a casting process and/or an ingot casting process such as a continuous casting process is followed by a steel raw material supply process; a heat treatment process such as heating; a hot working process such as hot rolling; other process such as cooling, shot blasting, and grinder; and thereafter an inspection process and a shipment process.

As long as the sound wave irradiation is performed under the predetermined conditions, the hydrogen content in steel in the final bar or wire can be reduced regardless of in which of these processes the sound wave irradiation is performed. Given that hydrogen inevitably enters into the steel in each process, from the viewpoint of shipping the steel material in a state in which the hydrogen content in steel is reduced more, the sound wave irradiation is preferably performed in the shipment process and/or a process close to the shipment process, namely, the inspection process, the grinder process, or the shot blasting process, more preferably performed in the inspection process or the grinder process, and further preferably performed in the inspection process. From the viewpoint of further reducing the final hydrogen content in steel, the sound wave irradiation is particularly preferably performed in two or more processes made up of the inspection process and any of the foregoing processes.

A more specific procedure when producing a bar or wire, for example, includes: passing a bar or wire through a heating furnace (heat treatment process); passing the bar or wire through a rougher (hot working process); passing the bar or wire through an intermediate water cooling zone (other process); passing the bar or wire through a finisher (hot working process); passing the bar or wire through a final cooling zone (other process); and coiling the bar or wire (other process). For example, the bar or wire is irradiated with sound waves using the sound wave irradiator installed between the final cooling zone and the coiling line.

Figure 7:
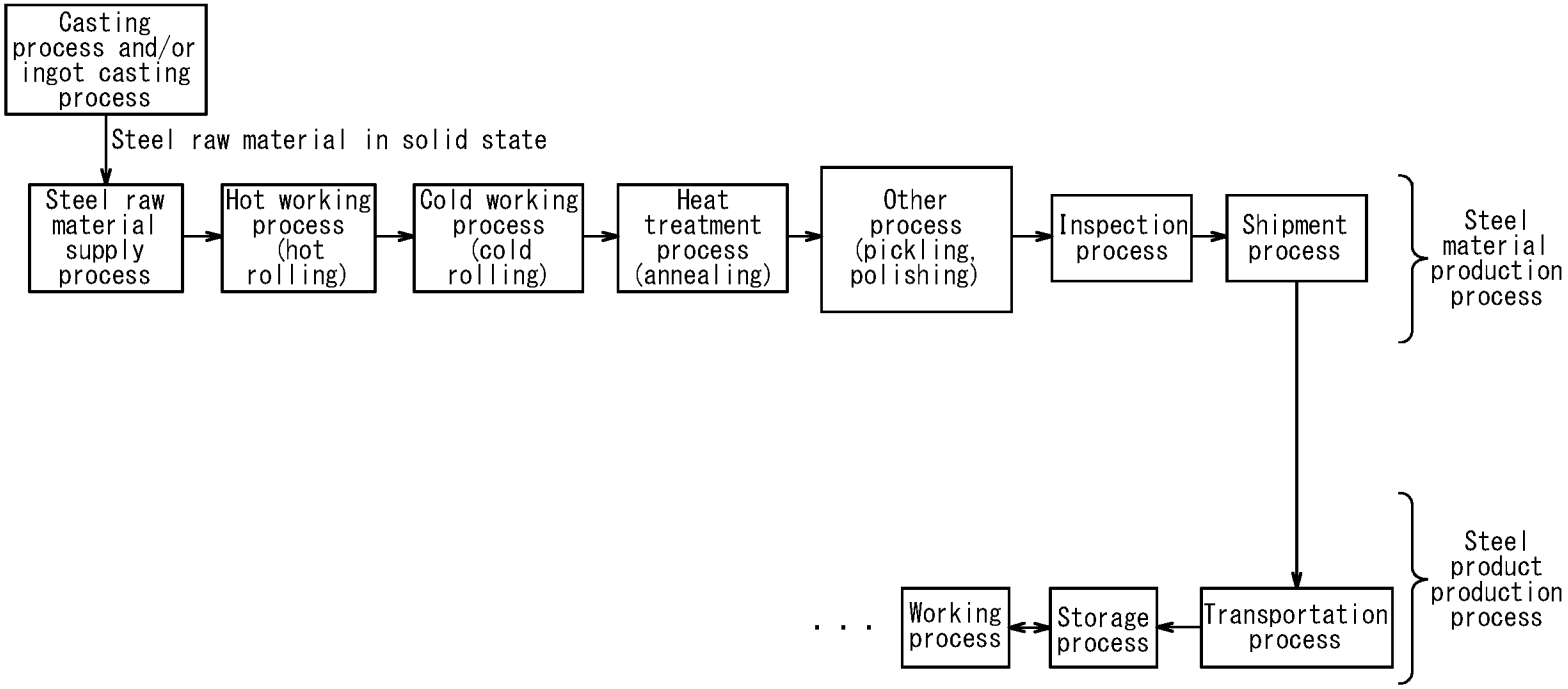
FIG. 7 is a flowchart illustrating an example of a production process in the case where a steel material is a stainless steel plate.

FIG. 7 illustrates an example of stainless steel plate production flow in the case where the steel plate is made of stainless steel. In a stainless steel plate production process in the upper part of FIG. 7, a casting process and/or an ingot casting process such as a continuous casting process is followed by a steel raw material supply process; a hot working process such as hot rolling; a cold working process such as cold rolling; a heat treatment process such as annealing; other process such as pickling and polishing; and thereafter an inspection process and a shipment process.

As long as the sound wave irradiation is performed under the predetermined conditions, the hydrogen content in steel in the final stainless steel plate can be reduced regardless of in which of these processes the sound wave irradiation is performed. Given that hydrogen inevitably enters into the steel in each process, from the viewpoint of shipping the steel material in a state in which the hydrogen content in steel is reduced more, the sound wave irradiation is preferably performed in the shipment process and/or a process close to the shipment process, namely, the inspection process, the polishing process, or the pickling process, more preferably performed in the inspection process or the polishing process, and further preferably performed in the inspection process. From the viewpoint of further reducing the final hydrogen content in steel, the sound wave irradiation is particularly preferably performed in two or more processes made up of the inspection process and any of the foregoing processes.

[Steel Product Production Process]

In the dehydrogenation method for a steel product according to the present disclosure, in a series of steel product production process including: a transportation process of transporting a steel material shipped from a steelworks; a storage process of storing the steel material; and a working process of working the steel material to obtain a steel product, the steel material (or the steel product, depending on the process) at any stage from the shipped steel material to any process out of the transportation process, the storage process, and the working process is irradiated with sound waves under predetermined conditions at least once. By irradiating the object steel in the steel product production process with sound waves, the hydrogen content in steel can be reduced sufficiently and efficiently, and the finally obtained steel product does not have quality loss caused by residual hydrogen.

As with the foregoing dehydrogenation method for a steel material, the dehydrogenation method for a steel product according to the present disclosure can be carried out, for example, by irradiating the steel material 20 or steel product 20 with sound waves using the sound wave irradiator 10 illustrated in FIG. 1, as illustrated in FIGS. 2A and 2B.

The sound wave irradiation conditions such as sound wave irradiation means, sound pressure level, frequency, and irradiation time in the dehydrogenation method for a steel product according to the present disclosure conform to those in the foregoing dehydrogenation method for a steel material. The hydrogen content in steel in the final steel product can be reduced regardless of in which of the transportation process, the storage process, and the working process in the steel product production process the sound wave irradiation is performed.

[Hydrogen Content in Steel]

Hydrogen in steel in the steel material or steel product subjected to the dehydrogenation treatment according to the foregoing method is reduced efficiently and sufficiently, as a result of the surface of the steel material or steel product being irradiated with sound waves and the steel material or steel product being forcibly vibrated. This is considered to be because forcibly vibrating the steel material or steel product causes the lattice spacing of the surface to expand, and hydrogen inside the steel is induced to diffuse to the tensile side which is advantageous with low potential energy and thus hydrogen diffusion is promoted, as mentioned above. The effect of reducing the hydrogen content in steel by the dehydrogenation treatment can be evaluated based on the reduced hydrogen ratio represented by the following equation (1) or (1)':

$$\text{Reduced hydrogen ratio (\%)}=(A-B)/A\times 100 \quad (1)$$

$$\text{Reduced hydrogen ratio (\%)}=(A'-B')/A'\times 100 \quad (1)'$$

where A is the hydrogen content in steel (ppm) of a steel material produced without using the dehydrogenation method by sound wave irradiation, B is the hydrogen content in steel (ppm) of a steel material produced using the dehydrogenation method by sound wave irradiation, A' is the hydrogen content in steel (ppm) of a steel product produced without using the dehydrogenation method by sound wave irradiation, and B' is the hydrogen content in steel (ppm) of a steel product produced using the dehydrogenation method by sound wave irradiation.

Herein, in the case where the reduced hydrogen ratio calculated according to the foregoing equation (1) or (1)' is 10% or more, it is determined that the hydrogen content in steel in the steel material or steel product can be reduced sufficiently.

The hydrogen content in steel in the steel material or steel product can be measured by the method described in the EXAMPLES section below.

(Production Method)

A production method for each of a steel material and a steel product according to the present disclosure comprises the foregoing dehydrogenation method. That is, in the production method according to the present disclosure, a steel raw material, a steel material, or a steel product is irradiated with sound waves under the foregoing predetermined conditions to sufficiently reduce the hydrogen content in steel, and thus a steel material or a steel product is produced. Each type of steel material or steel product obtained as a result does not have quality loss caused by residual hydrogen.

EXAMPLES

The presently disclosed techniques will be described in detail below by way of examples. The following examples are merely preferred examples according to the present disclosure, and the present disclosure is not limited to the following examples. Modifications can be made to the following examples within the range in which the subject matter of the present disclosure is applicable, with all such modifications being also included in the technical scope of the present disclosure.

First Example

In production processes of producing steel plates, shape steels, steel pipes or tubes, and bars or wires, various steel materials were produced with or without steel raw materials or steel materials being irradiated with sound waves, according to the conditions shown in Tables 1 to 4. The steel raw material or steel material in each process was in a solid state.

The number of times sound waves were applied in each process was 1.

From each of the obtained steel materials of steel plates, shape steels, steel pipes or tubes, and bars or wires, 100 test pieces of 30 mm in length and 5 mm in width were collected. For these test pieces, the hydrogen content in steel was measured by thermal desorption spectrometry (TDS). The average hydrogen content in steel (ppm) was calculated from the measured hydrogen contents in steel of the 100 test pieces of the steel material, and the reduced hydrogen ratio (%) was calculated from the average hydrogen content in steel and the foregoing equation (1).

The results are shown in Tables 1 to 4.

Second Example

In production processes of producing various steel products from steel plates, shape steels, steel pipes or tubes, or bars or wires (after steel material shipment process), various steel products were produced with or without steel materials being irradiated with sound waves, according to the conditions shown in Table 5. Each steel material was in a solid state.

The number of times sound waves were applied in each process was 1.

In the case of steel plates, steel products of construction machinery frames were produced by working processes such as shearing including laser cutting as a typical example, bending, blanking, and welding. In the production, sound waves were applied in a steel material transportation process, a steel material storage process, or laser cutting as a working process.

In the case of shape steels, steel products of steel H-beams were produced by working processes such as shearing and grinding. In the production, sound waves were applied in a steel material transportation process, a steel material storage process, or grinding as a working process.

In the case of steel pipes or tubes, steel products of automotive impact beams were produced by working processes such as shearing including laser cutting as a typical example, bending, and welding. In the production, sound waves were applied in a steel material transportation process, a steel material storage process, or laser cutting as a working process.

In the case of bars or wires, steel products of bolts were produced by working processes such as cold heading, heat treatment, and grinding. In the production, sound waves were applied in a steel material transportation process, a steel material storage process, or grinding as a working process.

For each of the steel products obtained from steel plates, shape steels, steel pipes or tubes, and bars or wires, the reduced hydrogen ratio (%) was calculated from the calculated average hydrogen content in steel and the foregoing equation (1)' in the same way as in the first example.

The results are shown in Table 5.

TABLE 1

| No. | Type of steel raw material or steel material | Sound wave irradiation treatment conditions (first time) | | | | Sound wave irradiation treatment conditions (second time) | | | | Evaluation | | Category |
|---|---|---|---|---|---|---|---|---|---|---|---|---|
| | | Production process | Sound pressure level (dB) | Frequency (Hz) | Total irradiation time in process (sec) | Production process | Sound pressure level (dB) | Frequency (Hz) | Total irradiation time in process (sec) | Average hydrogen content in steel of 100 steel material test pieces (ppm) | Reduced hydrogen ratio (%) | |
| 1 | Steel plate | — | — | — | — | — | — | — | — | 0.91 | 0 | Comparative Example |
| 2 | Steel plate | Steel raw material supply process | 100 | 8000 | 200 | — | — | — | — | 0.73 | 20 | Example |
| 3 | Steel plate | Heat treatment process | 100 | 8000 | 200 | — | — | — | — | 0.64 | 30 | Example |
| 4 | Steel plate | Cooling process | 100 | 8000 | 200 | — | — | — | — | 0.55 | 40 | Example |
| 5 | Steel plate | Heat treatment process | 100 | 8000 | 200 | — | — | — | — | 0.46 | 49 | Example |
| 6 | Steel plate | Shearing process | 100 | 8000 | 200 | — | — | — | — | 0.36 | 60 | Example |
| 7 | Steel plate | Shot blasting process | 100 | 8000 | 200 | — | — | — | — | 0.27 | 70 | Example |
| 8 | Steel plate | Coating process | 100 | 8000 | 200 | — | — | — | — | 0.18 | 80 | Example |
| 9 | Steel plate | Coating process | 100 | 8000 | 200 | Inspection process | 100 | 8000 | 200 | 0.05 | 95 | Example |
| 10 | Steel plate | Inspection process | 100 | 8000 | 200 | — | — | — | — | 0.09 | 90 | Example |
| 11 | Steel plate | Inspection process | 60 | 8000 | 200 | — | — | — | — | 0.46 | 49 | Example |
| 12 | Steel plate | Inspection process | 65 | 8000 | 200 | — | — | — | — | 0.36 | 60 | Example |
| 13 | Steel plate | Inspection process | 70 | 8000 | 200 | — | — | — | — | 0.27 | 70 | Example |
| 14 | Steel plate | Inspection process | 55 | 8000 | 200 | — | — | — | — | 0.55 | 40 | Example |
| 15 | Steel plate | Inspection process | 30 | 8000 | 200 | — | — | — | — | 0.77 | 15 | Example |
| 16 | Steel plate | Inspection process | 25 | 8000 | 200 | — | — | — | — | 0.84 | 8 | Comparative Example |
| 17 | Steel plate | Inspection process | 100 | 90000 | 200 | — | — | — | — | 0.04 | 96 | Example |
| 18 | Steel plate | Inspection process | 100 | 500 | 200 | — | — | — | — | 0.46 | 49 | Example |
| 19 | Steel plate | Inspection process | 100 | 75000 | 200 | — | — | — | — | 0.05 | 95 | Example |
| 20 | Steel plate | Inspection process | 100 | 80 | 200 | — | — | — | — | 0.64 | 30 | Example |
| 21 | Steel plate | Inspection process | 100 | 15 | 200 | — | — | — | — | 0.73 | 20 | Example |
| 22 | Steel plate | Inspection process | 100 | 8000 | 1200 | — | — | — | — | 0.05 | 95 | Example |
| 23 | Steel plate | Inspection process | 100 | 8000 | 3000 | — | — | — | — | 0.04 | 96 | Example |
| 24 | Steel plate | Inspection process | 100 | 8000 | 3200 | — | — | — | — | 0.02 | 98 | Example |
| 25 | Steel plate | Inspection process | 100 | 8000 | 3 | — | — | — | — | 0.64 | 30 | Example |
| 26 | Steel plate | Inspection process | 100 | 8000 | 2 | — | — | — | — | 0.73 | 20 | Example |
| 27 | Steel plate | Inspection process | 100 | 8 | 0.3 | — | — | — | — | 0.80 | 12 | Example |

Underlines indicate outside the range according to the present disclosure.

TABLE 2

| No. | Type of steel raw material or steel material | Sound wave irradiation treatment conditions (first time) | | | | Sound wave irradiation treatment conditions (second time) | | | | Evaluation | | Category |
|---|---|---|---|---|---|---|---|---|---|---|---|---|
| | | Production process | Sound pressure level (dB) | Frequency (Hz) | Total irradiation time in process (sec) | Production process | Sound pressure level (dB) | Frequency (Hz) | Total irradiation time in process (sec) | Average hydrogen content in steel of 100 steel material test pieces (ppm) | Reduced hydrogen ratio (%) | |
| 28 | Shape steel | — | — | — | — | — | — | — | — | 0.71 | 0 | Comparative Example |
| 29 | Shape steel | Steel raw material supply process | 100 | 8000 | 200 | — | — | — | — | 0.46 | 35 | Example |
| 30 | Shape steel | Hot working process | 100 | 8000 | 200 | — | — | — | — | 0.43 | 39 | Example |
| 31 | Shape steel | Heat treatment process | 100 | 8000 | 200 | — | — | — | — | 0.39 | 45 | Example |
| 32 | Shape steel | Oxide film removal (descaling) process | 100 | 8000 | 200 | — | — | — | — | 0.36 | 49 | Example |
| 33 | Shape steel | Rough rolling process | 100 | 8000 | 200 | — | — | — | — | 0.32 | 55 | Example |
| 34 | Shape steel | Intermediate rolling process | 100 | 8000 | 200 | — | — | — | — | 0.28 | 61 | Example |
| 35 | Shape steel | Finish rolling process | 100 | 8000 | 200 | — | — | — | — | 0.21 | 70 | Example |
| 36 | Shape steel | Tongue cut saw process | 100 | 8000 | 200 | — | — | — | — | 0.18 | 75 | Example |
| 37 | Shape steel | Hot saw process | 100 | 8000 | 200 | — | — | — | — | 0.14 | 80 | Example |
| 38 | Shape steel | Cooling process | 100 | 8000 | 200 | — | — | — | — | 0.12 | 83 | Example |
| 39 | Shape steel | Straightening process | 100 | 8000 | 200 | — | — | — | — | 0.11 | 85 | Example |
| 40 | Shape steel | Straightening process | 100 | 8000 | 200 | Inspection process | 100 | 8000 | 200 | 0.04 | 94 | Example |
| 41 | Shape steel | Inspection process | 100 | 8000 | 200 | — | — | — | — | 0.07 | 90 | Example |
| 42 | Shape steel | Inspection process | 60 | 8000 | 200 | — | — | — | — | 0.36 | 49 | Example |
| 43 | Shape steel | Inspection process | 65 | 8000 | 200 | — | — | — | — | 0.28 | 61 | Example |
| 44 | Shape steel | Inspection process | 70 | 8000 | 200 | — | — | — | — | 0.21 | 70 | Example |
| 45 | Shape steel | Inspection process | 55 | 8000 | 200 | — | — | — | — | 0.43 | 39 | Example |
| 46 | Shape steel | Inspection process | 30 | 8000 | 200 | — | — | — | — | 0.60 | 15 | Example |
| 47 | Shape steel | Inspection process | 25 | 8000 | 200 | — | — | — | — | 0.65 | 8 | Comparative Example |
| 48 | Shape steel | Inspection process | 100 | 90000 | 200 | — | — | — | — | 0.03 | 96 | Example |
| 49 | Shape steel | Inspection process | 100 | 500 | 200 | — | — | — | — | 0.36 | 49 | Example |
| 50 | Shape steel | Inspection process | 100 | 75000 | 200 | — | — | — | — | 0.04 | 94 | Example |
| 51 | Shape steel | Inspection process | 100 | 80 | 200 | — | — | — | — | 0.50 | 30 | Example |
| 52 | Shape steel | Inspection process | 100 | 15 | 200 | — | — | — | — | 0.57 | 20 | Example |
| 53 | Shape steel | Inspection process | 100 | 8000 | 1200 | — | — | — | — | 0.04 | 94 | Example |
| 54 | Shape steel | Inspection process | 100 | 8000 | 3000 | — | — | — | — | 0.03 | 96 | Example |
| 55 | Shape steel | Inspection process | 100 | 8000 | 3200 | — | — | — | — | 0.01 | 99 | Example |
| 56 | Shape steel | Inspection process | 100 | 8000 | 3 | — | — | — | — | 0.50 | 30 | Example |
| 57 | Shape steel | Inspection process | 100 | 8000 | 2 | — | — | — | — | 0.57 | 20 | Example |
| 58 | Shape steel | Inspection process | 100 | 7 | 0.3 | — | — | — | — | 0.62 | 13 | Example |

Underlines indicate outside the range according to the present disclosure.

TABLE 3

| No. | Type of steel raw material or steel material | Sound wave irradiation treatment conditions (first time) | | | | Sound wave irradiation treatment conditions (second time) | | | | Evaluation | | Category |
|---|---|---|---|---|---|---|---|---|---|---|---|---|
| | | Production process | Sound pressure level (dB) | Frequency (Hz) | Total irradiation time in process (sec) | Production process | Sound pressure level (dB) | Frequency (Hz) | Total irradiation time in process (sec) | Average hydrogen content in steel of 100 steel material test pieces (ppm) | Reduced hydrogen ratio (%) | |
| 59 | Steel pipe or tube | — | — | — | — | — | — | — | — | 0.86 | 0 | Comparative Example |
| 60 | Steel pipe or tube | Steel raw material supply process | 100 | 8000 | 200 | — | — | — | — | 0.52 | 40 | Example |
| 61 | Steel pipe or tube | Heat treatment process | 100 | 8000 | 200 | — | — | — | — | 0.43 | 50 | Example |
| 62 | Steel pipe or tube | Hot working process | 100 | 8000 | 200 | — | — | — | — | 0.34 | 60 | Example |
| 63 | Steel pipe or tube | Pipe or tube formation process | 100 | 8000 | 200 | — | — | — | — | 0.26 | 70 | Example |
| 64 | Steel pipe or tube | Forge welding process | 100 | 8000 | 200 | — | — | — | — | 0.17 | 80 | Example |
| 65 | Steel pipe or tube | Welding process | 100 | 8000 | 200 | — | — | — | — | 0.13 | 85 | Example |
| 66 | Steel pipe or tube | Welding process | 100 | 8000 | 200 | Inspection process | 100 | 8000 | 200 | 0.04 | 95 | Example |
| 67 | Steel pipe or tube | Inspection process | 100 | 8000 | 200 | — | — | — | — | 0.09 | 90 | Example |
| 68 | Steel pipe or tube | Inspection process | 60 | 8000 | 200 | — | — | — | — | 0.43 | 50 | Example |
| 69 | Steel pipe or tube | Inspection process | 65 | 8000 | 200 | — | — | — | — | 0.34 | 60 | Example |
| 70 | Steel pipe or tube | Inspection process | 70 | 8000 | 200 | — | — | — | — | 0.26 | 70 | Example |
| 71 | Steel pipe or tube | Inspection process | 55 | 8000 | 200 | — | — | — | — | 0.52 | 40 | Example |
| 72 | Steel pipe or tube | Inspection process | 30 | 8000 | 200 | — | — | — | — | 0.73 | 15 | Example |
| 73 | Steel pipe or tube | Inspection process | 25 | 8000 | 200 | — | — | — | — | 0.79 | 8 | Comparative Example |
| 74 | Steel pipe or tube | Inspection process | 100 | 90000 | 200 | — | — | — | — | 0.03 | 97 | Example |
| 75 | Steel pipe or tube | Inspection process | 100 | 500 | 200 | — | — | — | — | 0.43 | 50 | Example |
| 76 | Steel pipe or tube | Inspection process | 100 | 75000 | 200 | — | — | — | — | 0.04 | 95 | Example |
| 77 | Steel pipe or tube | Inspection process | 100 | 80 | 200 | — | — | — | — | 0.60 | 30 | Example |
| 78 | Steel pipe or tube | Inspection process | 100 | 15 | 200 | — | — | — | — | 0.69 | 20 | Example |
| 79 | Steel pipe or tube | Inspection process | 100 | 8000 | 1200 | — | — | — | — | 0.05 | 94 | Example |
| 80 | Steel pipe or tube | Inspection process | 100 | 8000 | 3000 | — | — | — | — | 0.03 | 97 | Example |
| 81 | Steel pipe or tube | Inspection process | 100 | 8000 | 3200 | — | — | — | — | 0.02 | 98 | Example |
| 82 | Steel pipe or tube | Inspection process | 100 | 8000 | 3 | — | — | — | — | 0.60 | 30 | Example |
| 83 | Steel pipe or tube | Inspection process | 100 | 8000 | 2 | — | — | — | — | 0.69 | 20 | Example |
| 84 | Steel pipe or tube | Inspection process | 100 | 8 | 0.4 | — | — | — | — | 0.76 | 12 | Example |

Underlines indicate outside the range according to the present disclosure.

TABLE 4

| No. | Type of steel raw material or steel material | Sound wave irradiation treatment conditions (first time) | | | | Sound wave irradiation treatment conditions (second time) | | | | Evaluation | | Category |
|---|---|---|---|---|---|---|---|---|---|---|---|---|
| | | Production process | Sound pressure level (dB) | Frequency (Hz) | Total irradiation time in process (sec) | Production process | Sound pressure level (dB) | Frequency (Hz) | Total irradiation time in process (sec) | Average hydrogen content in steel of 100 steel material test pieces (ppm) | Reduced hydrogen ratio (%) | |
| 85 | Bar or wire | — | — | — | — | — | — | — | — | 0.75 | 0 | Comparative Example |
| 86 | Bar or wire | Steel raw material supply process | 100 | 8000 | 200 | — | — | — | — | 0.45 | 40 | Example |
| 87 | Bar or wire | Heat treatment process | 100 | 8000 | 200 | — | — | — | — | 0.38 | 49 | Example |
| 88 | Bar or wire | Hot working process | 100 | 8000 | 200 | — | — | — | — | 0.30 | 60 | Example |
| 89 | Bar or wire | Cooling process | 100 | 8000 | 200 | — | — | — | — | 0.23 | 69 | Example |
| 90 | Bar or wire | Shot blasting process | 100 | 8000 | 200 | — | — | — | — | 0.15 | 80 | Example |
| 91 | Bar or wire | Grinder process | 100 | 8000 | 200 | — | — | — | — | 0.11 | 85 | Example |
| 92 | Bar or wire | Grinder process | 100 | 8000 | 200 | Inspection process | 100 | 8000 | 200 | 0.04 | 95 | Example |
| 93 | Bar or wire | Inspection process | 100 | 8000 | 200 | — | — | — | — | 0.08 | 89 | Example |
| 94 | Bar or wire | Inspection process | 60 | 8000 | 200 | — | — | — | — | 0.38 | 49 | Example |
| 95 | Bar or wire | Inspection process | 65 | 8000 | 200 | — | — | — | — | 0.30 | 60 | Example |
| 96 | Bar or wire | Inspection process | 70 | 8000 | 200 | — | — | — | — | 0.23 | 69 | Example |
| 97 | Bar or wire | Inspection process | 55 | 8000 | 200 | — | — | — | — | 0.45 | 40 | Example |
| 98 | Bar or wire | Inspection process | 30 | 8000 | 200 | — | — | — | — | 0.64 | 15 | Example |
| 99 | Bar or wire | Inspection process | 25 | 8000 | 200 | — | — | — | — | 0.69 | 8 | Comparative Example |
| 100 | Bar or wire | Inspection process | 100 | 90000 | 200 | — | — | — | — | 0.03 | 96 | Example |
| 101 | Bar or wire | Inspection process | 100 | 500 | 200 | — | — | — | — | 0.38 | 49 | Example |
| 102 | Bar or wire | Inspection process | 100 | 75000 | 200 | — | — | — | — | 0.04 | 95 | Example |
| 103 | Bar or wire | Inspection process | 100 | 80 | 200 | — | — | — | — | 0.53 | 29 | Example |
| 104 | Bar or wire | Inspection process | 100 | 15 | 200 | — | — | — | — | 0.60 | 20 | Example |
| 105 | Bar or wire | Inspection process | 100 | 8000 | 1200 | — | — | — | — | 0.05 | 93 | Example |
| 106 | Bar or wire | Inspection process | 100 | 8000 | 3000 | — | — | — | — | 0.03 | 96 | Example |
| 107 | Bar or wire | Inspection process | 100 | 8000 | 3200 | — | — | — | — | 0.02 | 97 | Example |
| 108 | Bar or wire | Inspection process | 100 | 8000 | 3 | — | — | — | — | 0.53 | 29 | Example |
| 109 | Bar or wire | Inspection process | 100 | 8000 | 2 | — | — | — | — | 0.60 | 20 | Example |
| 110 | Bar or wire | Inspection process | 100 | 7 | 0.3 | — | — | — | — | 0.66 | 12 | Example |

Underlines indicate outside the range according to the present disclosure.

TABLE 5

| No. | Type of steel material or steel material | Production process | Sound wave irradiation treatment conditions: Sound pressure level (dB) | Frequency (Hz) | Total irradiation time in process (sec) | Evaluation: Average hydrogen content in steel of 100 steel material test pieces (ppm) | Reduced hydrogen ratio (%) | Category |
|---|---|---|---|---|---|---|---|---|
| S1 | Steel plate | — | — | — | — | 0.99 | 0 | Comparative Example |
| S2 | Steel plate | Transportation process | 100 | 8000 | 200 | 0.05 | 95 | Example |
| S3 | Steel plate | Storage process | 100 | 8000 | 200 | 0.04 | 96 | Example |
| S4 | Steel plate | Working process | 100 | 8000 | 200 | 0.02 | 98 | Example |
| S5 | Shape steel | — | — | — | — | 0.77 | 0 | Comparative Example |
| S6 | Shape steel | Transportation process | 100 | 8000 | 200 | 0.04 | 95 | Example |
| S7 | Shape steel | Storage process | 100 | 8000 | 200 | 0.03 | 96 | Example |
| S8 | Shape steel | Working process | 100 | 8000 | 200 | 0.01 | 99 | Example |
| S9 | Steel pipe or tube | — | — | — | — | 0.90 | 0 | Comparative Example |
| S10 | Steel pipe or tube | Transportation process | 100 | 8000 | 200 | 0.05 | 94 | Example |
| S11 | Steel pipe or tube | Storage process | 100 | 8000 | 200 | 0.03 | 97 | Example |
| S12 | Steel pipe or tube | Working process | 100 | 8000 | 200 | 0.02 | 98 | Example |
| S13 | Bar or wire | — | — | — | — | 0.78 | 0 | Comparative Example |
| S14 | Bar or wire | Transportation process | 100 | 8000 | 200 | 0.05 | 94 | Example |
| S15 | Bar or wire | Storage process | 100 | 8000 | 200 | 0.03 | 96 | Example |
| S16 | Bar or wire | Working process | 100 | 8000 | 200 | 0.02 | 97 | Example |

Underlines indicate outside the range according to the present disclosure.

As is clear from Tables 1 to 5, in the steel material or steel product of each Example in which the sound wave irradiation treatment was performed under the predetermined conditions, the reduced hydrogen ratio was 10% or more, that is, the hydrogen content in steel was reduced sufficiently.

In the steel material or steel product of each Comparative Example in which sound wave irradiation was not performed or the sound pressure level of sound waves applied was less than 30 dB, the average hydrogen content in steel was higher than that of Example, and the reduced hydrogen ratio was a low level of less than 10%.

This demonstrates that the dehydrogenation method and the production method according to the present disclosure are useful because the hydrogen content in steel in steel materials and steel products can be reduced efficiently and sufficiently and a decrease in quality caused by hydrogen in the steel materials and steel products can be suppressed efficiently and sufficiently, with no need for a heat treatment which may cause microstructural changes and mechanical property changes of the steel materials and steel products.

INDUSTRIAL APPLICABILITY

It is thus possible to efficiently reduce hydrogen content in steel of thick or complexly-shaped steel materials and steel products in general, without changing the mechanical properties. It is also possible to produce, by using the dehydrogenation method, steel materials and steel products without a decrease in quality caused by residual hydrogen.

REFERENCE SIGNS LIST

10 sound wave irradiator
11 controller
12 sound wave oscillator
13 vibration transducer
14 booster
15 horn
16 sound level meter
20 steel raw material, steel material, steel product

The invention claimed is:

1. A dehydrogenation method for a steel material, wherein in a series of steel material production process including: a supply process of supplying a steel raw material; a hot working process of subjecting the steel raw material to hot working; an inspection process of inspecting a steel material obtained from the steel raw material; and a shipment process of shipping the steel material, at least one of the steel raw material and the steel material at any stage from the supply process to the shipment process is subjected to, at least once, a treatment of irradiating with sound waves, without contacting the steel raw material or the steel material, from a sound wave irradiator located apart from a surface of the steel raw material or the steel material and toward the surface, the sound wave irradiator includes a controller, a sound wave oscillator, a vibration transducer, a booster, a horn and a sound level meter, so that a sound pressure level at the surface of the at least one of the steel raw material and the steel material will be 30 dB or more and thereby hydrogen content in the steel material will be reduced.

2. The dehydrogenation method according to claim 1, wherein the series of steel material production process further includes a cold working process of subjecting the steel material after the hot working process to cold working.

3. The dehydrogenation method according to claim 1, wherein the sound waves have a frequency from 10 Hz to 100000 Hz.

4. The dehydrogenation method according to claim 1, wherein a sound wave irradiation time in the treatment of irradiating with the sound waves is 1 second or more.

5. The dehydrogenation method according to claim 2, wherein the sound waves have a frequency from 10 Hz to 100000 Hz.

6. The dehydrogenation method according to claim 2, wherein a sound wave irradiation time in the treatment of irradiating with the sound waves is 1 second or more.

7. The dehydrogenation method according to claim 3, wherein a sound wave irradiation time in the treatment of irradiating with the sound waves is 1 second or more.

8. The dehydrogenation method according to claim 5, wherein a sound wave irradiation time in the treatment of irradiating with the sound waves is 1 second or more.

9. A dehydrogenation method of claim 1, wherein hydrogen content in the steel material will be reduced by 10% or more.

10. A dehydrogenation method of claim 1, wherein the steel material during the inspection process stage is subjected, at least once, to the treatment of irradiating with sound waves.

11. A dehydrogenation method of claim 1, wherein the sound pressure level at the surface of the at least one of the steel raw material and the steel material will be 60 dB or more.

* * * * *